US005672247A

United States Patent [19]

Pangalos et al.

[11] Patent Number: 5,672,247

[45] Date of Patent: Sep. 30, 1997

[54] CONTROL SCHEME FOR RAPID PULP DELIGNIFICATION AND BLEACHING

[75] Inventors: George Pangalos, Plainsboro, N.J.; Ronald A. Falcone, Jr.; William L. Mayo, both of Chesapeake, Va.; Gregory J. Bosch, Yardville, N.J.

[73] Assignee: Union Camp Patent Holding, Inc., Wayne, N.J.

[21] Appl. No.: 399,717

[22] Filed: Mar. 3, 1995

[51] Int. Cl.[6] ..... D21C 1/00

[52] U.S. Cl. ..... 162/65; 162/238

[58] Field of Search ..... 162/238, 49, 62, 162/65

[56] References Cited

U.S. PATENT DOCUMENTS

| | | | |
|---|---|---|---|
| 3,607,623 | 9/1971 | Chappelle . | |
| 3,617,717 | 11/1971 | Smith . | |
| 3,650,890 | 3/1972 | Kamio . | |
| 4,155,806 | 5/1979 | Mannbro . | |
| 4,198,266 | 4/1980 | Kirk et al. . | |
| 4,248,662 | 2/1981 | Wallick . | |
| 4,278,496 | 7/1981 | Fritzvold . | |
| 4,279,694 | 7/1981 | Fritzvold et al. . | |
| 4,348,256 | 9/1982 | Bergstrom et al. . | |
| 4,372,812 | 2/1983 | Phillips et al. . | |
| 4,384,920 | 5/1983 | Markham et al. . | |
| 4,431,480 | 2/1984 | Markham et al. . | |
| 4,459,174 | 7/1984 | Papageorges et al. . | |
| 4,595,455 | 6/1986 | Mannbro . | |
| 4,619,733 | 10/1986 | Kooi . | |
| 4,840,703 | 6/1989 | Malmsten . | |
| 4,978,425 | 12/1990 | Beller et al. . | |
| 5,173,153 | 12/1992 | Terrett et al. . | |
| 5,174,861 | 12/1992 | White et al. . | |
| 5,181,989 | 1/1993 | White et al. . | |
| 5,403,441 | 4/1995 | McDonald | 162/65 |

FOREIGN PATENT DOCUMENTS

| | | | |
|---|---|---|---|
| 999950 | 11/1976 | Canada . | |
| 1132760 | 10/1982 | Canada . | |
| 1154205 | 9/1983 | Canada . | |
| 2067844 | 11/1992 | Canada . | |
| 0 047 656 A1 | 3/1982 | European Pat. Off. . | |
| 162258 | 5/1972 | New Zealand . | |
| 162119 | 7/1972 | New Zealand . | |
| 158 591 | 11/1972 | New Zealand . | |
| 167756 | 4/1974 | New Zealand . | |
| 169558 | 4/1974 | New Zealand . | |
| 175 906 | 7/1977 | New Zealand . | |
| 194 036 | 11/1983 | New Zealand . | |
| 232 530 | 7/1992 | New Zealand . | |
| WO 94/23123 | 10/1984 | WIPO . | |
| WO 91/18145 | 11/1991 | WIPO . | |
| WO 94/15018 | 7/1994 | WIPO . | |
| WO 94/29512 | 12/1994 | WIPO | 162/65 B |

OTHER PUBLICATIONS

Kappel et al. "High–consistency ozone–bleaching technology". Tappi Journal. 1994. vol. 77, No. 6, pp. 109–116.

M. Ollila, "Chemical Pulp Bleaching Control Based on Inline Brightness and Residual Measurements Before and After Stage," Tappi Porceedings, 1988 Pulping Conferences, pp. 603–608 1988.

White et al., "Importance of Reactor Design in High Consistency Ozone Bleach," Pulp & Paper Canada, vol. 94, No. 9, pp. 242–247 (1993) 1993.

R.P. Singh, "Ozone Replaces Chlorine in the First Bleaching Stage," Tappi, vol. 64, No. 2, pp. 45–48 (Feb. 1982) 1982.

U. Germgard et al., "Ozone Prebleaching of a Modified–Cooked and Oxygen–Bleached Softwood Kraft Pulp," Svensk Papperstidning, No. 15, 1985, pp. 127–132 1985.

Patt et al, "Use of Ozone for Pulp Bleaching," 42(10A): V14–23 (Oct. 1988) 1988.

Seymour et al, "Testing and Control in Bleach Plants," Bleaching of Pulp, Tappi, 3rd edition, p. 478. 1979 1979.

Liebergott et al., "$O_2$, $O_3$ and Peroxide", *Seminar Notes, 1978, Pulping and Bleaching Seminar,* pp. 90–105.

Singh, "Computer Control", *The Bleaching of Pulp,* Tappi Press, 1979, pp. 503–513.

Burnett, "Computer Control of the Chlorine Stage", *Pulp and Paper Magazine of Canada,* vol. 71, No. 14, Jul. 17, 1970, pp. 57–62.

H. deV. Partridge, "Pulp & Paper Technology: New Pulp Bleaching Developments," pp. 45–50, Jun. 1976, *CEP.* .

J.K. Perkins et al., "Advances in Ozone Bleaching —Part III," pp. 263–266.

G.A. Smook, *Handbook for Pulp & Paper Technologists,* pp. 154–172, Tappi.

John S. Fujii te al., "Oxygen Pulping of Hardwoods," pp. 1–12.

K.H. Ferguson, "Union Camp Begins Ozone Era with New Kraft Bleaching Line at Franklin, Va.," Nov. 1992, pp. 42–55, *Pulp & Paper.*

F.G. Shinskey, *Process Control Systems —Application, Design, and Tuning,* Third Edition, pp. 4–7, 10–11, 14–15, 18–19, 42–43, 120–121, 1988, McGraw–Hill.

A.G. Jamieson et al., "Washing System," May 1973, pp. 187–191, *Svensk Papperstidning.*

B.S. Kirk et al., "Low–Consistency Oxygen Delignification in a Pipeline Reactor," May 1978, pp. 77–80, *Tappi,* vol. 61, No. 5.

*Primary Examiner*—Anthony J. Weier

*Attorney, Agent, or Firm*—Nath & Associates; Gary M. Nath; Suet Chong

[57] ABSTRACT

A process control for adjusting bleaching agent application in response to the pulp brightness and/or K number is realized by utilizing a coupled control feedforward and/or feedback control system or combination thereof wherein brightness measurements are made between successive K number measurements and adjustments made to the bleaching agent application in response to a comparison value.

16 Claims, 7 Drawing Sheets

CONTROL SCHEME FOR RAPID PULP DELIGNIFICATION AND BLEACHING

BACKGROUND OF THE INVENTION

1. Field of the Invention

The present invention relates to the pulping industry and, more particularly, to a coupled control process for controlling the degree of delignification or bleaching.

2. Description of the Prior Art

Wood is comprised of two main components—a fibrous carbohydrate, i.e., cellulosic portion, and a non-fibrous component. The polymeric chains forming the fibrous cellulose portion of the wood are aligned with one another and form strong associated bonds with adjacent chains. The non-fibrous portion comprises a three-dimensional polymeric material known as lignin. Part of the lignin is between the cellulosic fibers, bonding them into a solid mass, although a substantial portion of the lignin is also distributed within the fibers themselves. Lignin is the material in paper pulp which causes its brown appearance and which must be removed to produce white paper.

For use in paper-making processes, wood must first be reduced to pulp. Pulp may be defined as wood fibers capable of being slurried or suspended and then deposited upon a screen to form a sheet, i.e., of paper. Pulping of the wood by the well known kraft or modified kraft pulping processes results in the formation of a dark colored slurry of cellulose fibers known as "brownstock". See, for example, Rydholm, *Pulping Processes*, Interscience Publishers, 1965 and TAPPI Monograph No. 27, *The Bleaching of Pulp*, Rapson, Ed., The Technical Association of Pulp and Paper Industry (1963).

The dark color of the brownstock is attributable to the fact that not all of the lignin is removed during digestion and becomes chemically modified during pulping to form chromophoric groups. Thus, to lighten the color of the brownstock pulp, it is necessary to continue to remove the remaining lignin by the addition of delignifying materials and by chemically converting any residual lignin into colorless compounds by a process known as "bleaching" or "brightening".

The delignification and bleaching processes are conducted on washed fibrous mass in a series of steps using selected combinations of chemical reactants. In the prior art, various combinations of chemical treatments have been suggested, such as with the use of elemental chlorine, chlorine dioxide, ozone, oxygen, hypochlorite, hydrogen peroxide and alkali. Each of these chemical treatments, however, has various disadvantages. Chlorine has a negative environmental impact. Hypochlorite is known to reduce pulp strength and also causes environmental concerns. Excessive application of the remaining agents can cause degradation of the pulp integrity or strength.

Chlorine dioxide has less of an environmental impact than elemental chlorine. Nevertheless, inefficient use of the chemical will result in under-bleached pulp if too little is applied and weakened pulp if excess is applied. This excess also increases the negative environmental impact due to the production of organo-chlorine compounds. Therefore, proper control is desirable. When chlorine dioxide is used in reaction sequences where it is contacted with pulp for a short time, such as in WO 94/15018, a significant part of the reaction occurs in a short period of time requiring a rapid responding control scheme. For this discussion, "a significant part of the reaction" refers to consuming about 25% or more of the available chemical reactant and a "short time" refers to about 5 minutes or less, preferably less than about 2 minutes and most preferably about 0.1 second to 100 seconds.

To avoid the use of chlorine containing agents, the use of ozone has been proposed. Advantageously, ozone will readily react with lignin to effectively reduce the amount of lignin in the pulp. Under many conditions, it will, however, deleteriously attack the carbohydrate which comprises the cellulosic fibers of the wood to substantially reduce the strength of the resultant pulp. Ozone, moreover, is extremely sensitive to process conditions with respect to its oxidative and chemical stability, and such changes can significantly alter the reactivity of the ozone with respect to the lignocellulosic materials.

Since the delignifying capabilities of ozone were first recognized around the turn of the century, there has been substantial and continuous work in the field to develop a commercially suitable method using ozone in the bleaching of lignocellulosic materials. Such a method has proven to be difficult for several reasons, one being the fast speed within which the bleaching process is completed.

A novel apparatus and method for bleaching pulp with ozone in a commercially feasible manner to produce a high grade bleached pulp is disclosed in U.S. Pat. No. 5,181,989 granted Jan. 26, 1993, entitled "Pulp Bleaching Method," and U.S. Pat. No. 5,174,861 granted Dec. 29, 1992, entitled "Method of Bleaching High Consistency Pulp With Ozone". Under defined parameters, a gaseous ozone bleaching agent is used to provide a highly selective removal and bleaching of the lignin with minimal degradation of cellulose. Process parameters that must be controlled include pulp feed rate, pulp particle or agglomerate size, pulp consistency, pulp pH, pulp temperature, degree of pulp delignification, ozone feed concentration, ozone feed rate, ozone application on pulp which is a function of ozone concentration and gas flow rate, and the residence time of both the gas and the pulp in the ozone reactor. Within the reactor vessel, the pulp is advanced in a dispersed plug flow manner that subjects substantially all of the pulp particles or agglomerates to the ozone in a continuous and uniform fashion to obtain a substantially uniformly increased brightness pulp.

While the above-mentioned apparatus is advantageous in that chlorinated materials may be avoided in the bleaching process so that virtually all the liquid filtrates can be recycled and recovered, it would be further desirable to improve the control of the degree of bleaching across the ozone reactor to achieve a more consistent exiting pulp quality, as measured by such parameters as pulp brightness or Kappa number. Kappa number (or the equivalent K number value) is a measure of the quantity of lignin in the pulp and represents a real chemical measurement. In addition, it is important to rapidly achieve a new steady state, for example, following a planned change in production rate or target brightness. Moreover, due to the relatively short residence time of the pulp with the ozone in a continuous reactor, there is the need to rapidly adjust the ozone application to minimize under- or over-bleaching and achieve target brightness with optimum ozone consumption. From all the above, control of the application of chemical treatments will optimize delignification and bleaching, while minimize pulp degradation and waste. The prior art does not provide effective control schemes for fast reacting chemical treatments such as both high and medium consistency ozone, short duration chlorine dioxide treatments and other fast reacting chemical treatments.

To attempt to overcome some of the prior art deficiencies encountered, several control methods have been proposed.

Canadian Patent 999,950 provides a feed forward type control algorithm which is designed for maximum dynamic effectiveness by compensating for the inherent time delay between chlorine addition and sensor position. Also the process provides for variations in chlorination temperature and in retention time. In particular, the process provides for sensing a color value related to a Kappa number after the pulp has been subjected to a bleaching agent; providing a prediction model which is in response to said sensed value, the amount of bleaching agent added, and temperature and retention time in the premixer and reactor means, to predict the future value of the Kappa number after being withdrawn relative to the present amount of bleaching agent being added; and then comparing the predicted future value after being withdrawn from the reactor with a set point reference. The amount of bleaching agent is then changed in response to a lack of comparison.

In contrast, M. Ollila in a paper presented at TAPPI 1988 Pulping Conference, held in New Orleans, USA, 30 Oct.–2 Nov. 1988, Vol. 3, pp. 603–608 (Atlanta, USA: TAPPI Press, 1988 761 pp, discloses a dual sensor control which uses brightness and residual measurements. The process provides for control of the chemical dosage level, compensates for the effects of sudden process changes (such as variation in incoming Kappa number, production, temperature, consistency and carryover) and helps to achieve a stable Kappa number after the E-stage. Details are given of an improved version of a dual sensor control equipment with long feedback control which combines short delay brightness and residual with after tower brightness and residual measurements.

SUMMARY OF THE INVENTION

To avoid confusion, the detailed description of this invention will be with reference to ozone gas even though other gaseous bleaching reagents, such as chlorine monoxide, chlorine dioxide, and others are possible. Moreover, the expressions "bleaching agent" or "chemical treating agent" or "chemical reactant" will refer to the mixture of ozone in carrier gas (oxygen) plus the other gases and vapors present, at equilibrium, in various sections of the reactor apparatus.

It is the nature of the measurement of pulp properties, such that those properties which are true measures of lignin content require longer times to conduct. Generally, with current technology, it takes at least about five minutes to measure such properties for example as Kappa number, K number, Klason lignin and the like.

Properties which can be measured quickly or continuously on-line, such as brightness are not consistent because of fluctuations in the measurement due to many variables such as fiber type, pH, consistency, temperature and the like which effect the measurement but do not reflect changes in lignin content. These fluctuations are generally modest over short periods of time, for example up to 30 minutes of pulp processing in a bleach plant, but can be much greater over longer periods. Previous attempts to rely on brightness alone to control a fast, short time, bleaching process have failed for this reason.

The present invention overcomes this deficiency by correlating a rapid or continuous measure of pulp property such as brightness with a true pulp property measure such as Kappa number, K number, Klason lignin or similar measure of lignin content. It is this correlation when applied to control the application of a chemical treatment agent to pulp that is termed "coupled control".

In a production mill setting, this correlation is performed on-line. During the period between successive lignin content measurements, the secondary pulp property such as brightness is used to control application of chemical treating agents to the pulp.

The secondary pulp property is re-correlated or calibrated to reflect true lignin content periodically with a true measure of lignin content such as Kappa number, K number, Klason lignin or the like.

This technique can be utilized in feed forward, feedback and combination control schemes.

The present process involves a coupled control method for controlling the bleaching of pulp utilizing a feedforward and feedback measurement. More particularly, the method involves the use of rapidly obtained brightness measurements to modify the quantity of feed ozone between successive K number measurements. Ozone charge is established through aggressive feed forward action based on K number measurements entering the ozone reactor and soft feedback action based on measurements of K number exiting the reactor.

Specifically, the feedforward control adjusts the amount of bleaching agent to a reactor based on on-line measurements of a characteristic property of the pulp entering the reactor, ingoing amounts of pulp and bleaching agent concentration. More particularly, using a predictive equation based on the operating characteristics of the reactor, the bleaching agent application required to achieve a desired characteristic pulp property or degree of bleaching is calculated and the amount of bleaching agent entering the reactor adjusted accordingly. Sensors in a feedback loop configuration with the reactor, monitor the outgoing pulp property.

Because of the relatively short gas and pulp residence times present in some plug flow reactors, and high sensitivity to operating parameters, the exiting pulp properties rapidly respond to changes in the feed pulp properties, production rate, and/or other operating conditions. Advantageously, the process control in accordance with the present invention affords a method for controlling the amount of ozone application to the pulp to most rapidly achieve a desired exiting pulp property or degree of bleaching despite these varying operating conditions.

In a preferred embodiment, the coupled control involves a method for controlling a continuous ozone bleaching process for paper pulp to a desired degree of bleaching, which comprises adding feed ozone at a desired amount to the pulp, passing the pulp continuously into and out of a bleaching reactor, measuring the brightness value of the pulp between successive K number measurements, and adjusting the quantity of feed ozone in response to the measured values required to reach a desired degree of bleaching.

A particularly preferred procedure for adjusting the quantity of feed ozone involves periodically measuring the K number of the incoming pulp as it passes into the reactor and adjusting the amount of feed ozone to obtain the desired degree of bleaching, measuring the pulp brightness between the periodic K number measurements, and making a moving average of several pulp brightness measurements, comparing the moving average brightness measurement with the brightness representing the K number for that period prior to the next K number measurement in order to initiate a change in feed ozone, and adjusting the quantity of feed ozone in response to the comparison value.

A further preferred procedure involves the use of a predictive equation to calculate the desired amount of ozone while eliminating spurious measurements through a moving average.

There are various methods for utilizing the feedforward control and/or the feedback control or combination thereof. In one embodiment, during startup and under feedforward control, the ozone application is base loaded to the reactor. Once having reached a steady state operation, the ozone application is adjusted solely under the coupled control procedure.

BRIEF DESCRIPTION OF THE DRAWINGS

A more complete understanding of the invention may be obtained by reading the following description in conjunction with the appended drawings in which.

DETAILED DESCRIPTION OF THE INVENTION

Figure 1:
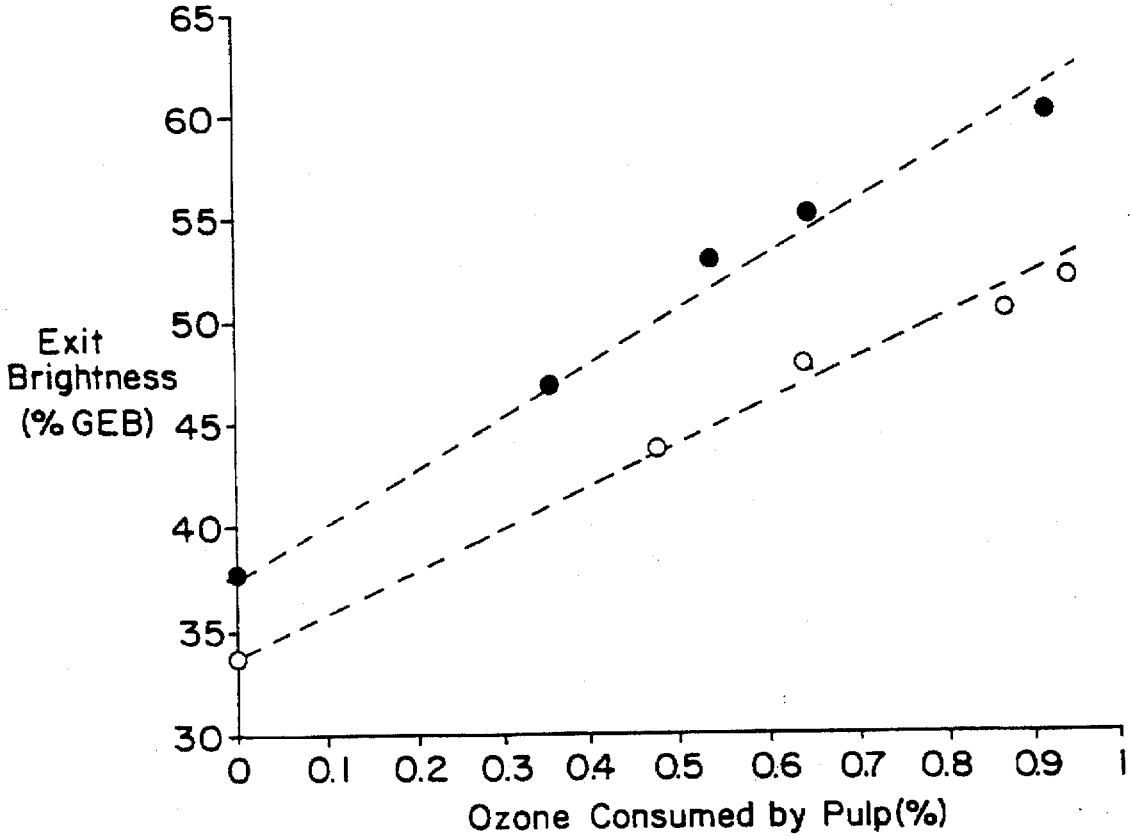
FIG. 1 is a graph of the exiting pulp brightness versus ozone consumption (%) for two different brightness levels of the entering pulp.

The present invention relates to a novel coupled control process for controlling the degree or extent of bleaching or brightening of pulp, particularly ozone bleaching, while minimizing the amount of ozone required.

The method for controlling an ozone bleaching process to reach a desired degree of bleaching, comprises adding feed ozone at a desired amount to the pulp, passing the pulp continuously into and out of a bleaching reactor; measuring the brightness value of the pulp between successive K number measurements and adjusting the quantity of feed ozone required to reach a desired degree of bleaching in response to these measured values.

More particularly, the process of the invention involves adjusting the feed ozone by periodically measuring the K number of the incoming pulp as it passes into the reactor and then adjusting the amount of feed ozone to obtain the desired degree of bleaching; measuring the pulp brightness between periodic K number measurements, and making a moving average of several pulp brightness measurements; comparing the moving average brightness measurement with the brightness representing the K number for that period prior to the next K number measurement and adjusting the quantity of feed ozone in response to the comparison value.

For convenience in understanding the improvements over the prior art by the presently disclosed process control, the definitions of parameters used throughout this specification are provided below.

The phrase "degree of delignification" is normally used in connection with the pulping process and the early bleaching stages. It tends to be less precise when only small amounts of lignin are present in the pulp, i.e., in the later bleaching stages.

The "brightness" factor is normally used in connection with the bleaching process because it tends to be more precise when the pulp is lightly colored and its reflectivity is high.

There are many methods of measuring the degree of delignification, but most are variations of the permanganate test. Permanganate tests provide a permanganate number ("K number") and/or a Kappa number which are related to the number of cubic centimeters of one-tenth normal potassium permanganate solution consumed by one gram of oven dried pulp under specified conditions. The Kappa number is determined by TAPPI Standard Test T-236, while the K number is described in the TAPPI Useful Method UM-226 and in the TAPPI Useful Method UM-229.

There are also a number of methods of measuring pulp brightness. This parameter is usually a measure of reflectivity and its value is expressed as a percent of some scale. A standard measurement is the General Electric Brightness (GEB) which is a measurement of directional reflectance and is expressed as a percentage of a maximum GEB value and can be obtained by following TAPPI Standard Method T-452.

Control of an outgoing pulp property such as K number with variability in one or more process parameters, e.g., ingoing pulp K number or production rate, is obtained by the present process. Preferably, the process is utilized to control a bleaching reactor that employs ozone even though it should be recognized that other bleaching agents may be employed.

Advantageously, bleaching with ozone under properly defined conditions minimizes the degree of attack upon the cellulosic portion of the wood, thereby forming a product having acceptable strength and brightness properties for the manufacture of papers and various paper products.

Although the present dual control process is suitable for use in various systems for delignifying and brightening pulp, the process will be described in combination with the ozone reactor disclosed in U.S. Pat. Nos. 5,181,989 and 5,174,861 as well as the corresponding processes disclosed in U.S. Pat. Nos. 5,164,043 and 5,164,044, all of which are incorporated herein by reference.

Specifically, it has been found that the ozone reactor disclosed in U.S. Pat. No. 5,181,989 operates substantially in a plug flow type manner. In an ideal plug flow reactor, all of the material flowing through the reactor has the same residence time, i.e., it spends substantially the same amount of time in the reactor before emerging at the other end. Accordingly, a reference to "plug flow" is to be understood to mean that the residence time distribution of the pulp particles or agglomerates with the gaseous bleaching agent is as narrow as possible such that most of the pulp particles or agglomerates spend substantially the same amount of time in the reactor.

For convenience in understanding the present invention, the invention comprises various measuring steps and corrective algorithms, including, but not limited to, the following steps:

(1) specifying a target exiting pulp property such as K number and identified as target K-Out (target $K_{Out}$);

(2) measuring on-line the K number of the ingoing pulp in a manner well-known in the art, measured and identified as K number-In ($K_{In}$);

(3) specifying a target K number of the ingoing pulp identified as target K number In (target $K_{In}$);

(4) measuring the operating parameters of the ozone reactor, including temperature, pH, gas flow rate, ozone concentration, and ingoing pulp flow rate;

(5) measuring on-line the brightness number of the ingoing and outgoing pulp between successive K number measurements at each location;

(6) under feedforward control (predictive control), calculating and adjusting the ozone application needed to achieve a desired degree of bleaching for the current operating parameters of the reactor; and (7) under feedback control, further adjusting the ozone application to achieve the desired degree of bleaching, as defined by a target K number or a standardized laboratory brightness measurement.

A controlling factor for the bleaching of the pulp is the relative amount of the ozone used to bleach a given amount of the pulp. This amount is determined, at least in part, by the amount of lignin which is to be removed during the ozone bleaching process, balanced against the relative amount of degradation of the cellulose that can be tolerated during ozone bleaching.

There are many control problems involved in bleaching pulp, not the least of which is a wide variation in the wood source. Trees grown in different locations, even though they are exactly the same species, may have highly different lignin qualities. This wide variation in wood quality results in bleaching processes whereby the resulting pulp whiteness is not consistent. Other control difficulties arise because of the differences in concentrations in bleaching chemicals, fluctuations in pulp consistency, differences in the incoming pulp K number and unforeseen changes that occur within the bleaching process.

The amount of lignin to be removed during ozone bleaching is an important factor in control of the ozone bleaching stage. This amount of lignin is related to the degree of brightening desired across the stage, i.e., the difference between the ingoing and outgoing pulp brightness levels.

FIG. 1 graphically shows the exiting pulp brightness as a function of ozone consumption. The GEB measurements presented in FIG. 1 are standardized laboratory values where most of the conditions affecting the measurement value, such as pH and temperature, are fixed. The data shown in FIG. 1 were laboratory ozone bleaching data on pine pulp taken at two different levels of entering pulp brightness; 35% and 37.5% GEB as indicated by the solid and open circles, respectively. As shown in FIG. 1, there is a clear relationship between the pulp brightness after exiting the ozone bleaching stage and the ozone consumption in the ozone stage. Also, there is a clear relationship between the entering pulp brightness and how much ozone consumption is required in the ozone stage to achieve a specific exit brightness. Furthermore, there is a well known relationship between standardized pulp brightness and lignin content of pulp, such that the more lignin removed the brighter the pulp appears. It follows from these trends that the feedbackward and feedforward control according to the invention can be applied effectively in the bleaching of pulp with ozone.

The ozone gas which is used in the bleaching process may be employed as a mixture of ozone with oxygen and/or an inert gas, or as a mixture of ozone with air. The amount of ozone which can satisfactorily be incorporated into the treatment gases is limited by the capability of the ozone generation to economically generate ozone, as well as by the stability of the ozone in the gas mixture. Ozone gas mixtures which typically, but not necessarily, contain about 1–14% by weight of ozone/oxygen mixture, are suitable for use in the bleaching process. A preferred mixture is 6% ozone with the balance predominantly oxygen. A higher concentration of ozone in the ozone/oxygen mixture allows for the use of relatively smaller size reactors, and a shorter reaction time to treat equivalent amounts of pulp.

The reaction temperature at which the ozone bleaching is conducted is likewise an important controlling factor in the optimal operation of the ozone bleaching reactor. The ozone bleaching can be effectively conducted at temperatures up to a certain level. Above this level, the reaction commences to cause excessive degradation of the cellulose and increased ozone requirement to reach a target brightness level, due to factors such as increased ozone decomposition at higher temperatures. The reaction temperature of ozonation of southern U.S. pine is preferably below 150° F.

Changes in the pH conditions may also significantly affect the delignification of lignocellulosic materials during ozonation.

The duration of the reaction used for the ozone bleaching step is determined by the desired degree of bleaching or brightening required in this stage. It is important that this ozone bleaching reaction be accomplished with complete or substantially complete consumption of the ozone, i.e., ozone conversion. The reaction time will vary depending upon factors such as the efficiency of mixing of the pulp with the ozone, the concentration of the ozone in the ozone gas mixture, with relatively more concentrated ozone mixtures reacting more quickly, and the relative amount of lignin which it is desired to remove.

An important feature of the invention is maintaining a target level of K number or standardized brightness despite varying production rate and operating parameters. This feature is obtained, in part, by monitoring the above controlling factors, among others, to adjust the amount of ozone application for the given operating conditions in order to achieve a desired standardized brightness, change in standardized brightness or desired K number or change in K number. As used in this application, the term "K number" represents all forms of permanganate measurements (including Kappa number), as well as other lignin content measurements.

As discussed above, it is the nature of the measurement of pulp properties, such that those properties which are true measures of lignin content require longer times to conduct. Generally, with current technology, it takes at least about five minutes to measure such properties for example as Kappa number, K number, Klason lignin and the like.

Properties which can be measured quickly or continuously on-line, such as brightness are not consistent because of fluctuations in the measurement due to many variables such as fiber type, pH, consistency, temperature and the like which effect the measurement but do not reflect changes in lignin content.

These fluctuations are generally modest over short periods of time, for example up to 30 minutes of pulp processing in a bleach plant, but can be much greater over longer periods. Previous attempts to rely on brightness alone to control a fast, short time, bleaching process have failed for this reason.

The present invention overcomes this deficiency by correlating a rapid or continuous measure of pulp property such as brightness with a true pulp property measure such as Kappa number, K number, Klason lignin or similar measure of lignin content. It is this correlation when applied to control the application of a chemical treatment agent to pulp that is termed "coupled control".

In a production mill setting, this correlation is performed on-line. During the period between successive lignin content measures, the secondary pulp property such as brightness is used to control application of chemical treating agents to the pulp.

The secondary pulp property is re-correlated or calibrated to reflect true lignin content periodically with a true measure of lignin content such as Kappa number, K number, Klason lignin or the like.

This technique can be utilized in feed forward, feedback and combination control schemes.

K Number and Brightness Measurement

The K number of the incoming pulp is measured just prior to entering the reactor, and preferably prior to acidulation. As an example, Model KNA-5000 sold by the Bonnier Technology Group having a relative accuracy of ±2% of the measured value for K numbers between 7.5–75 and a relative accuracy of ±2.5% of the measured value for K numbers between 1.5–7.5 may be employed as a sensor for measuring the K number of the ingoing pulp. The K number measurements are usually taken periodically about twice every hour at the entrance to and exit from the reactor. The incoming measurement is identified as the K number-In ($K_{In}$). The exit measurement is identified as K number-Out ($K_{Out}$). With each K number measurement, a new brightness of the incoming pulp and/or outgoing pulp is captured. These captured brightnesses are referred to as captured $GEB_{In}$ and captured $GEB_{Out}$.

For the ozone-bleached pulp leaving the reactor, the K number measurements are made after exiting the reactor by the sensors discussed above. Typically, the sensor has an accuracy of ±2.5% of the measured value for K numbers less than seven.

It is also advantageous to employ a moving average of three successive K number measurements, confounding spurious measurements.

It should be recognized that the minimum resolution time of a completely dedicated K number measuring device is about five minutes and that the residence time of the pulp in a continuous plug flow reactor is typically less than two minutes. As such, while the K number is being measured, drastic changes might occur to the incoming pulp.

Figure 2:
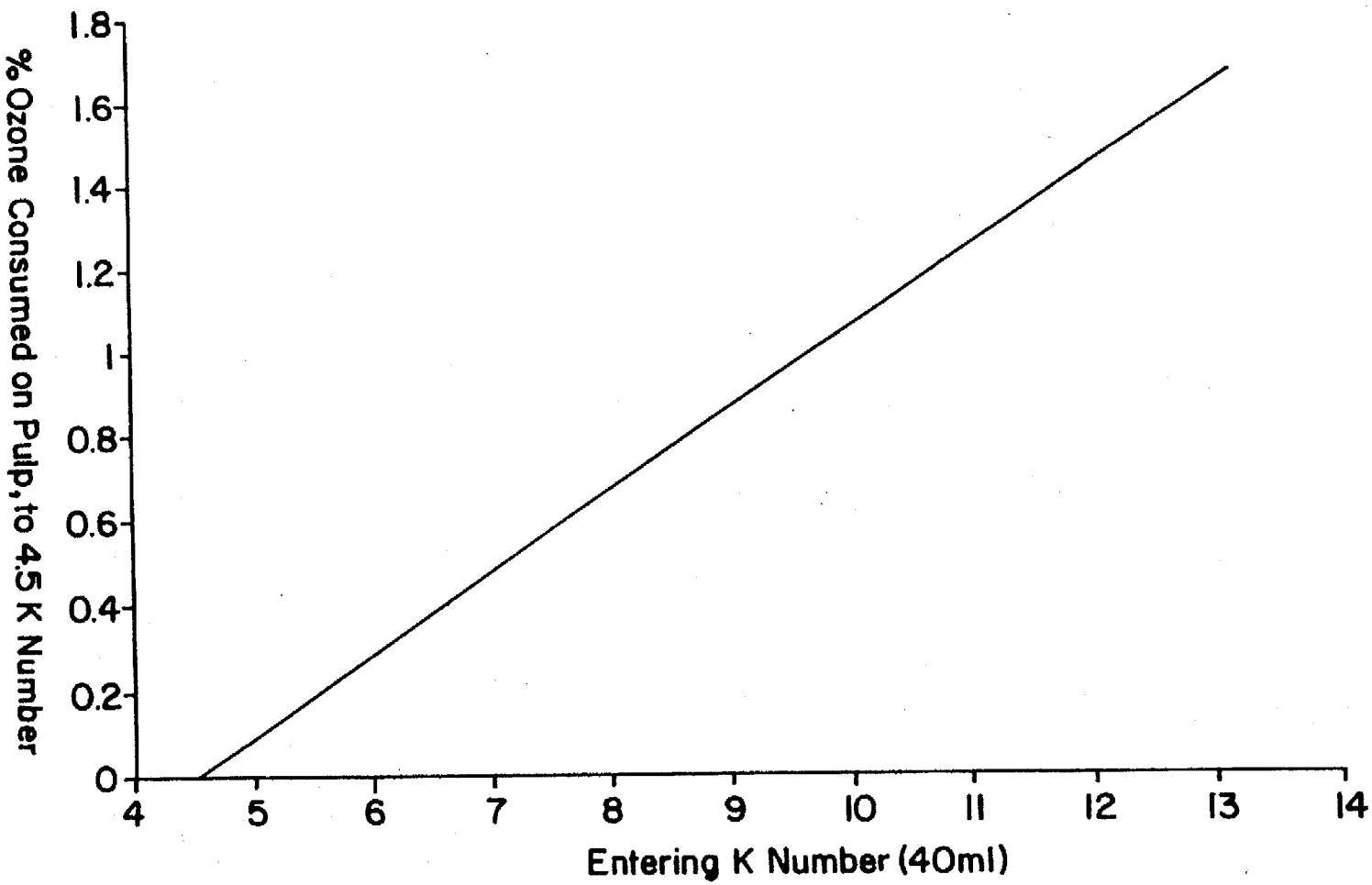
FIG. 2 is a graph of the ozone consumption (%) to achieve an exiting pulp K number of 4.5, versus entering pulp K number.

FIG. 2 shows a graphical representation of the relationship between the ozone consumed to reach a specific exiting pulp K number and ingoing pulp K number for a specific set of reactor operating parameters.

Ongoing Brightness Measurement

Another step in the present invention is to measure the ongoing pulp brightness of the pulp supplied to the bleaching reactor between successive K number measurements. The ozone reactor utilizes an on-line brightness sensor such as Model BT-5000 sold by the Bonnier Technology Group, to measure the ongoing pulp brightness entering the reactor. In operation, the pulp is exposed to four discrete wavelengths of light and four light detectors gather the scattered light from the pulp and conduct it to a photo-detector. The intensity of the scattered light is proportional to the brightness of the pulp. Typically, the sensor is dedicated to sampling a specific location and accordingly continuously samples the brightness of the ongoing pulp with a reproducability of ±0.5 GEB units.

The brightness measurements are made during the interval between successive K number measurements. In this way, the ozone feed is established through accurate and aggressive feedforward action based on the K number and brightness measurements entering the ozone reactor and the soft feedback action based on measures of the exiting K number and brightness.

The coupled control system is thus able to anticipate the change in the lignin content in the entering pulp and adjusts the quantity of feed ozone or other chemical treatment accordingly.

The control system preferably does not take immediate action upon measuring a small change in brightness, but rather uses a moving average of the pulp brightness to initiate a change in the feed ozone. Thus, the control system is shown to respond to quick but real changes in incoming pulp quality, which is especially important for quick-reacting systems. The brightness measurements are made between successive K number measurements. They may be done periodically or continuously. Preferred measuring times may be from about a second to about 10 minute intervals with times of about 3 seconds to about 5 minutes being most preferred.

Coupled Process Control Strategy

The general strategy for controlling the degree of pulp bleaching is to dynamically control the amount of ozone application. Preferably, a process control strategy is based on feedforward control along with feedback control. Under feedforward control, the ozone application to the reactor is appropriately adjusted to match the calculated ozone application derived from the relationship set forth in the following equation to achieve the desired degree of bleaching.

The ingoing measured pulp property is the pulp K number-In ($K_{In}$) and the outgoing measured pulp property is the K-number Out ($K_{Out}$) and the desired degree of bleaching is the target K number-Out (target $K_{Out}$). Upon taking successive K number measurements of incoming pulp, $K_{In}$ is compared with an expected target K number-In (target $K_{In}$). If the $K_{In}$ matches the target $K_{In}$, a specific amount of ozone is applied to the pulp. This amount of ozone ($C_1$) is the amount of ozone that is projected as required to reach the desired K number-Out, i.e., the desired degree of bleaching. If the $K_{In}$ and target $K_{In}$ are different, the ozone applied is modified accordingly ($C_2(K_{In}-[\text{target } K_{In}])$).

The "$GEB_{In}$" and "$GEB_{Out}$" are the pulp brightness values measured between consecutive K number measurements at the entrance and exit of the ozone reactor respectively. With each K number measurement, a new brightness of the ingoing pulp and/or outgoing pulp is captured. These captured brightnesses are referred to as "captured $GEB_{In}$" and "capture $GEB_{Out}$". The $GEB_{In}$ is compared with the captured $GEB_{In}$ and their difference is used to modify the applied ozone in the feedforward portion of the control strategy. Similarly, the $GEB_{Out}$ is compared with the captured $GEB_{Out}$ and their difference is used to modify the applied ozone in the feedback portion of the control strategy. Calculating the ozone application required to bleach the pulp step comprises the formula $$O_{3app}=C_1+C_2([K_{In}]-[\text{target } K_{In}])+C_3([\text{captured } GEB_{In}]-[GEB_{In}])+C_4([K_{Out}]-[\text{target } K_{Out}])+C_5([\text{captured } GEB_{Out}]-[GEB_{Out}])$$

wherein $O_{3app}$ is the calculated ozone application necessary to achieve target bleaching, and $C_1$ through $C_5$ are constants. Those skilled in the art will readily note that for other reactors, constants $C_1$ through $C_5$ will be different and can be easily determined by routine testing and collection of data for the particular reactor and pulp that is selected.

The feedback control strategy includes assessing the current status of an outgoing pulp property and measuring the difference between this measured value and the desired (target) value of that pulp property, for example its K number. Once the difference between the desired pulp property and outgoing pulp property has been measured and compared to the ongoing brightness calculations, the ozone application, or more exactly the gas flow rate at a fixed ozone concentration, is accordingly increased or decreased until the desired target property level is detected by on-line sensors located at the exiting feed line of the pulp.

The various control functions and calculations are implemented by function blocks configured from control diagrams developed by SAMA Standards, which are well known in the art. Typically, the control system hardware utilized is implemented by distributed microprocessors, each of which is dedicated to performing a specific function. The processing elements are linked to one another to form an integrated process control system, typically with a highly parallel distributed architecture. These devices are all well known in the art and accordingly are not discussed herein.

The following examples are illustrative of preferred embodiments of the invention and are not to be construed as limiting the invention thereto.

EXAMPLE 1

Inventive Runs A to F

Figure 3A:
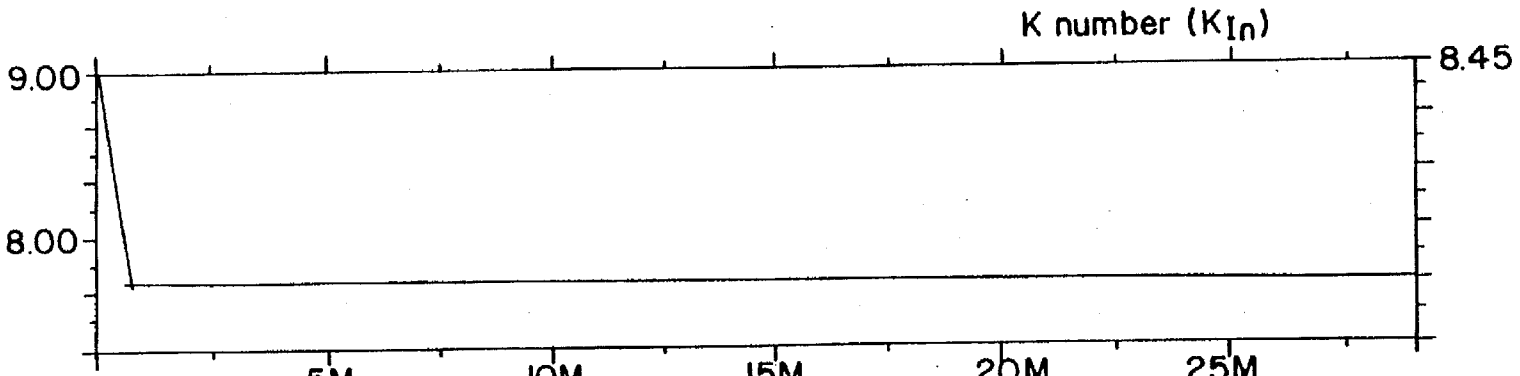
FIGS. 3*a*, 4*a*, 5*a* and 6*a* are K numbers entering the ozone stage.
Figure 3B:
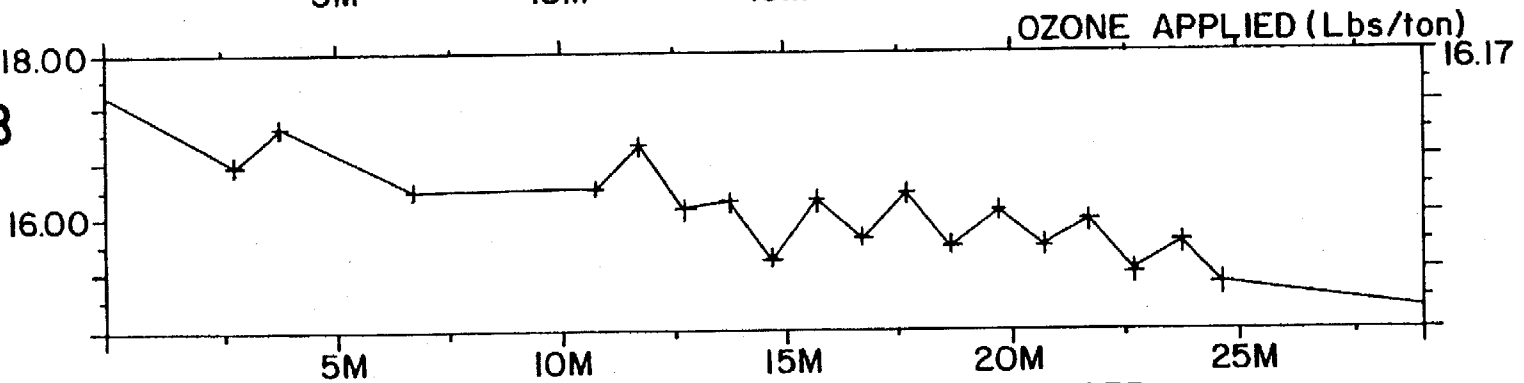
FIGS. 3*b*, 4*b*, 5*b* and 6*b* depict applied ozone.
Figure 3C:
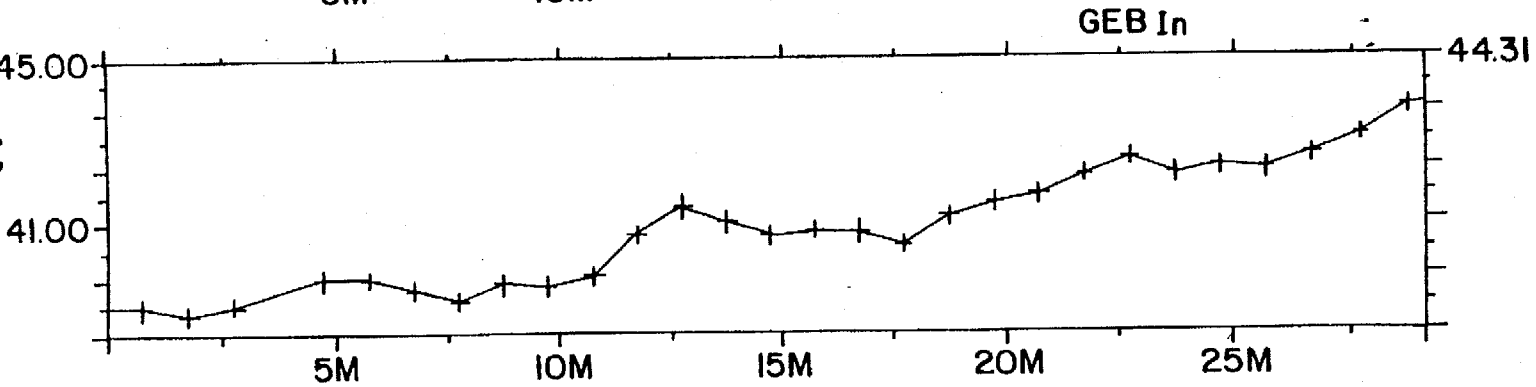
FIGS. 3*c*, 4*c*, 5*c* and 6*c* are graphs of the brightness of incoming pulp.
Figure 4A:
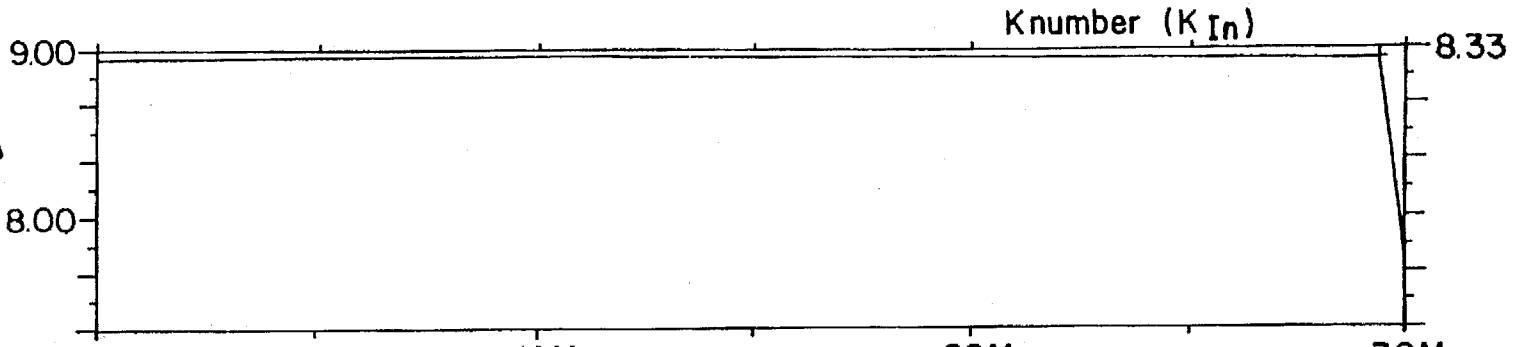
Figure 4B:
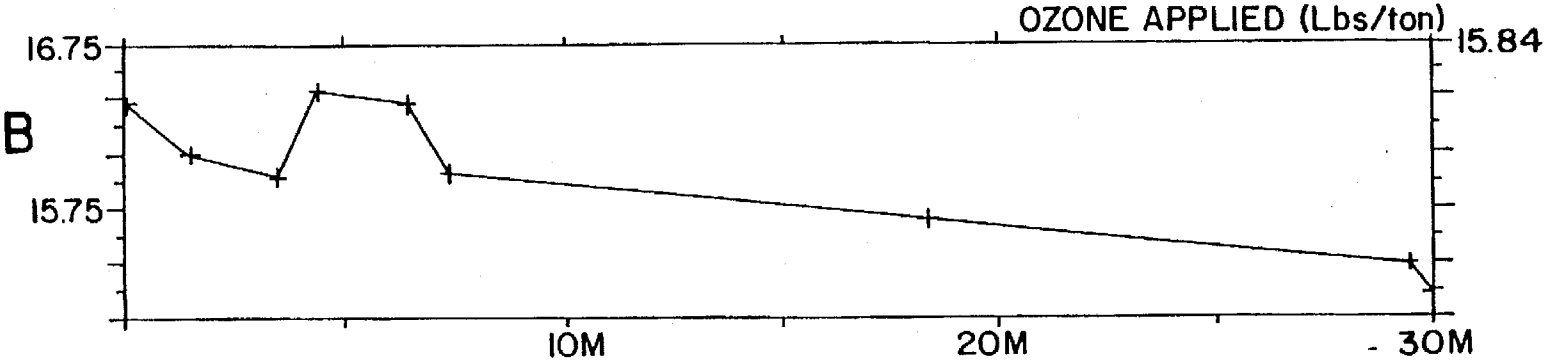
Figure 4C:
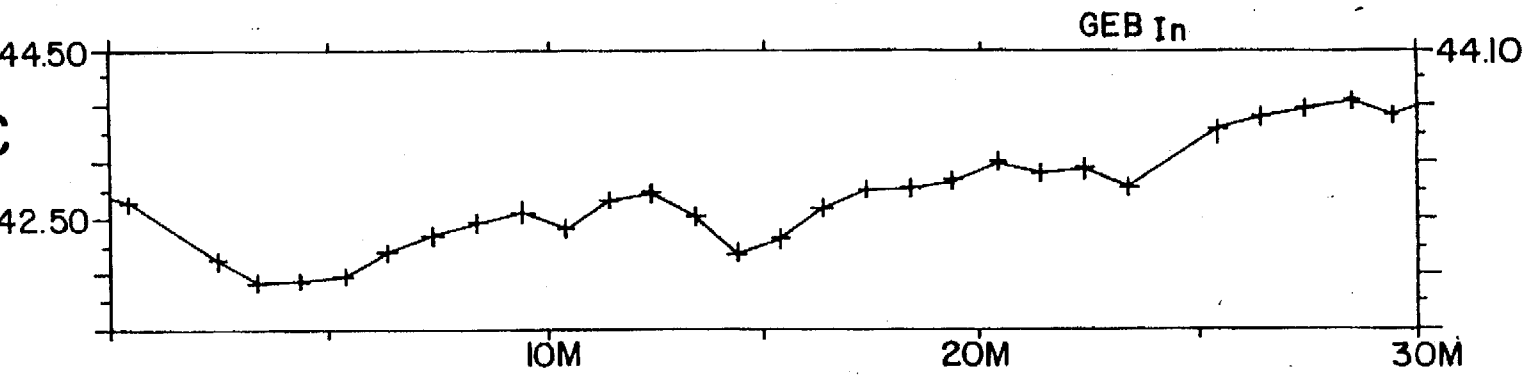

FIGS. 3*a*, 3*b*, 3*c*, 4*a*, 4*b* and 4*c* show three process variables (on-line) as they change during bleaching; each variable is depicted separately. FIGS. 3*a* and 4*a* show the post oxygen stage K number—a measure of the lignin content of the pulp. In both cases the K number did not change for nearly 30 minutes, which is the typical time between consecutive measurements of K number of the pulp entering the plug flow ozonation reactor. In the graphs, an actual measurement is denoted by a cross and the lines simply connect the measured values which are plotted at specific intervals. The minimum resolution-time of a completely dedicated K number measuring device is about five minutes and the residence time of the pulp in the ozone reactor is typically less than two minutes. FIGS. 3*b* and 4*b* show the ozone application to the reactor, while FIGS. 3*c* and 4*c* show the brightness of pre-ozone stage-pulp. Between successive K number measurements, changes took place in the pre-ozone-stage pulp (entering the Z-stage) which were recorded as changes in the pulp brightness. The control system used this information to anticipate the eventual change in the lignin content of the post-stage pulp and forced changes in the applied ozone charge (expressed as pounds per ton, PPT).

EXAMPLE 2

Inventive Runs G to N

Figure 5A:
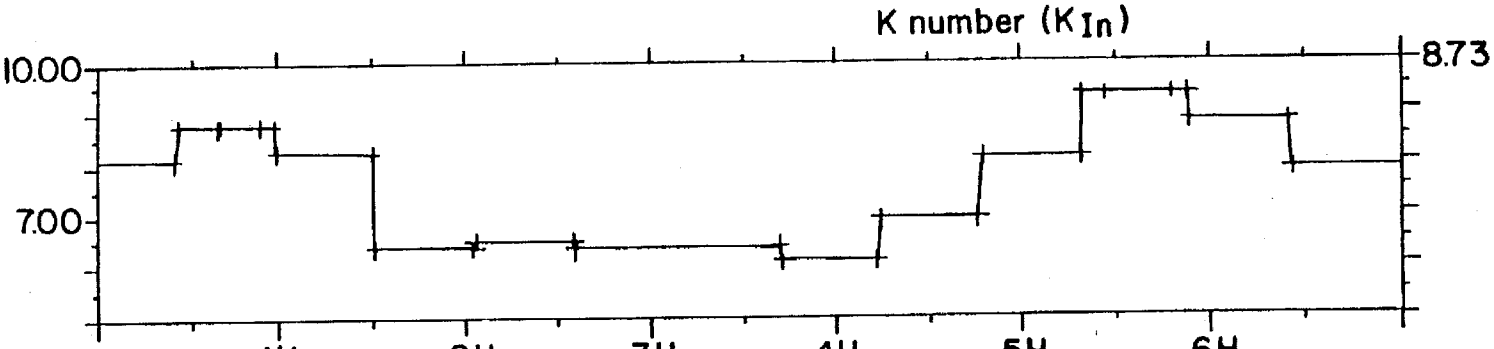
Figure 5B:
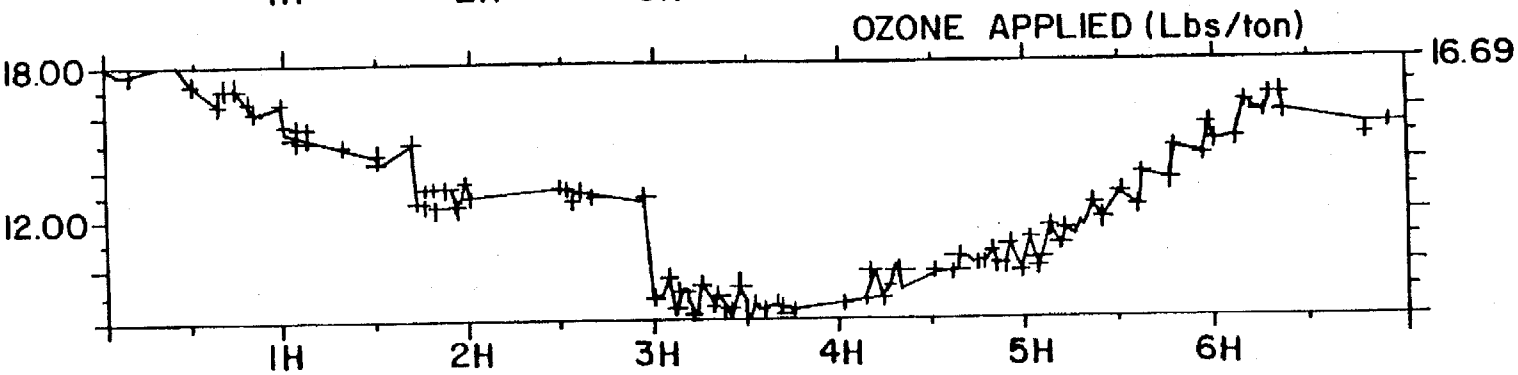
Figure 5C:
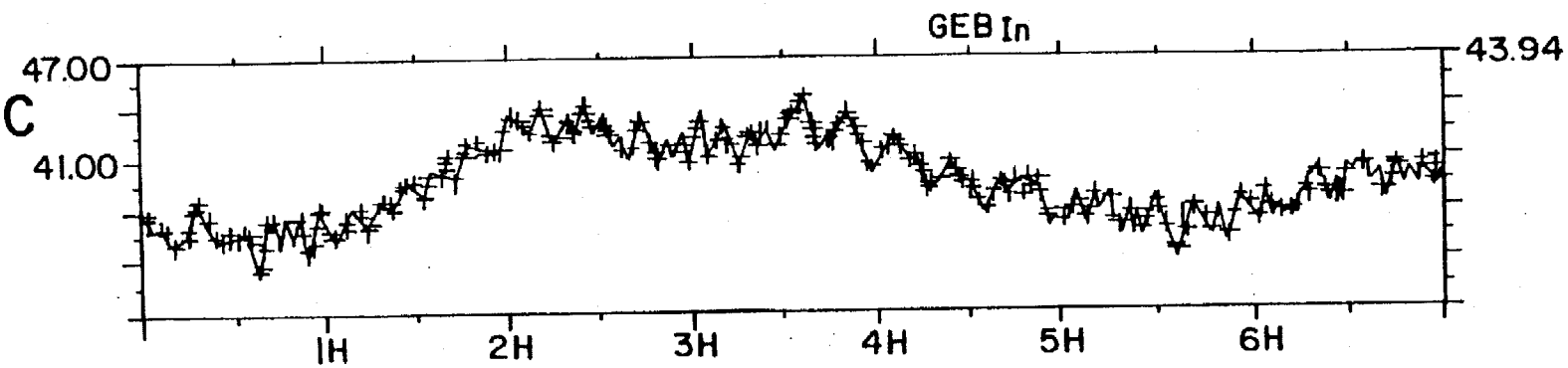
Figure 6A:
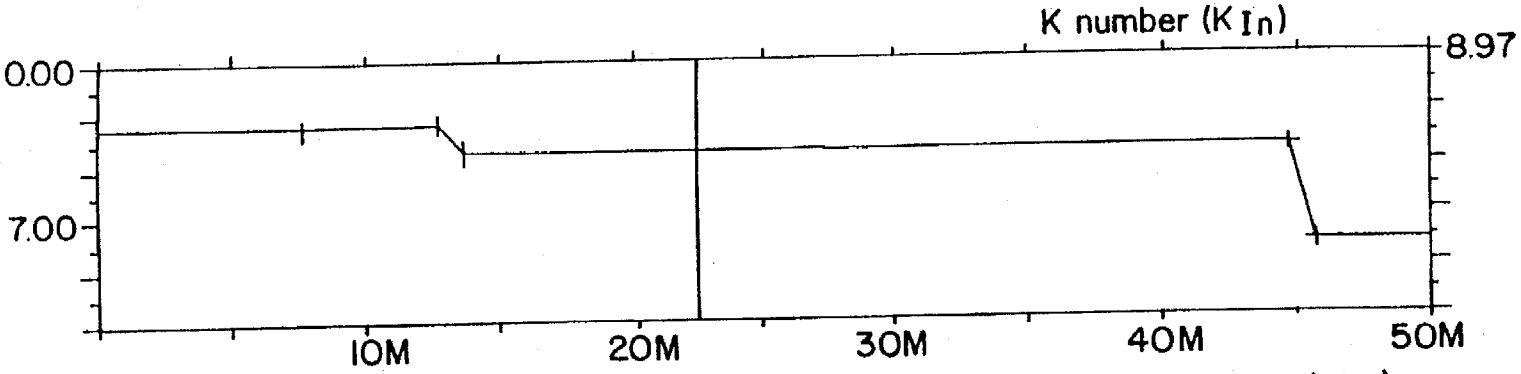
Figure 6B:
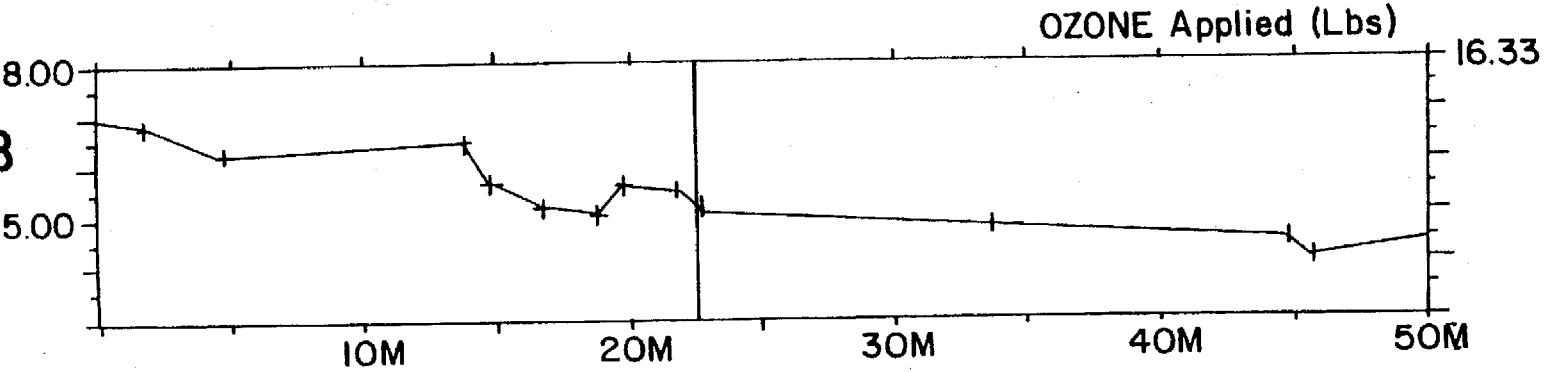
Figure 6C:
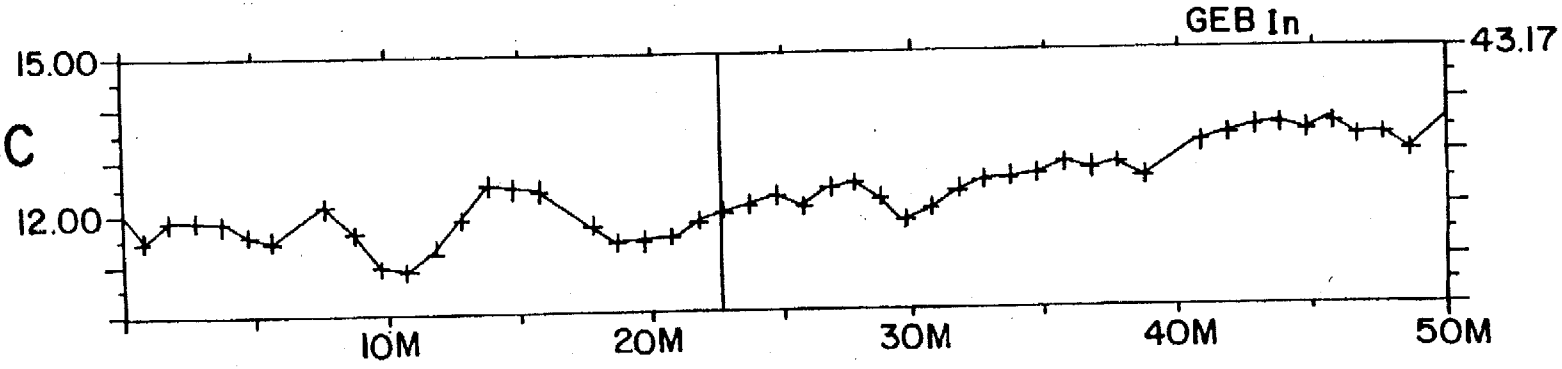

FIGS. 5*a*, 5*b* and 5*c* show the progress of an ozone bleaching process using a plug flow reactor over a 7 hour period, while FIGS. 6*a*, 6*b* and 6*c* show the progress of operations over a 50 minute period that same day. Three process variables (on-line) are shown—each in a separate figure. FIGS. 5*a* and 6*a* show the post-oxygen-stage K number—a measure of the lignin content of the pulp. Actual measurements are denoted by a cross and the lines simply connect the measured values which are plotted at specific intervals. The post oxygen stage K number is measured at about 25 minute intervals. The minimum resolution-time of a completely dedicated K number measuring device is about five minutes and that the residence time of the pulp in the ozone reactor is typically less than two minutes.

FIGS. 5*b* and 6*b* show the ozone application to a reactor, while FIGS. 5*c* and 6*c* show the brightness of the pre ozonation-stage pulp.

Between successive K number measurements, changes took place in the post oxygen or pre ozone stage pulp which were recorded as changes in the pulp brightness. The control system used this information to anticipate the eventual change in the K number (measured 25 minutes later) of the pre-ozonation-stage pulp and forced changes in the applied ozone charge (expressed as pounds per ton, PPT).

The control system does not take immediate action upon measuring a small change in brightness, but rather uses a moving average of the pulp brightness to initiate a change in the applied ozone. Similarly, the control system employs a moving average of three K number measurements, confounding spurious measurements. The control system is shown to respond to quick but real changes in incoming pulp quality, which is especially important for quick-reacting systems. The pulp tonnage during the 50 minute period in FIG. 6 was relatively stable.

Figure 7A:
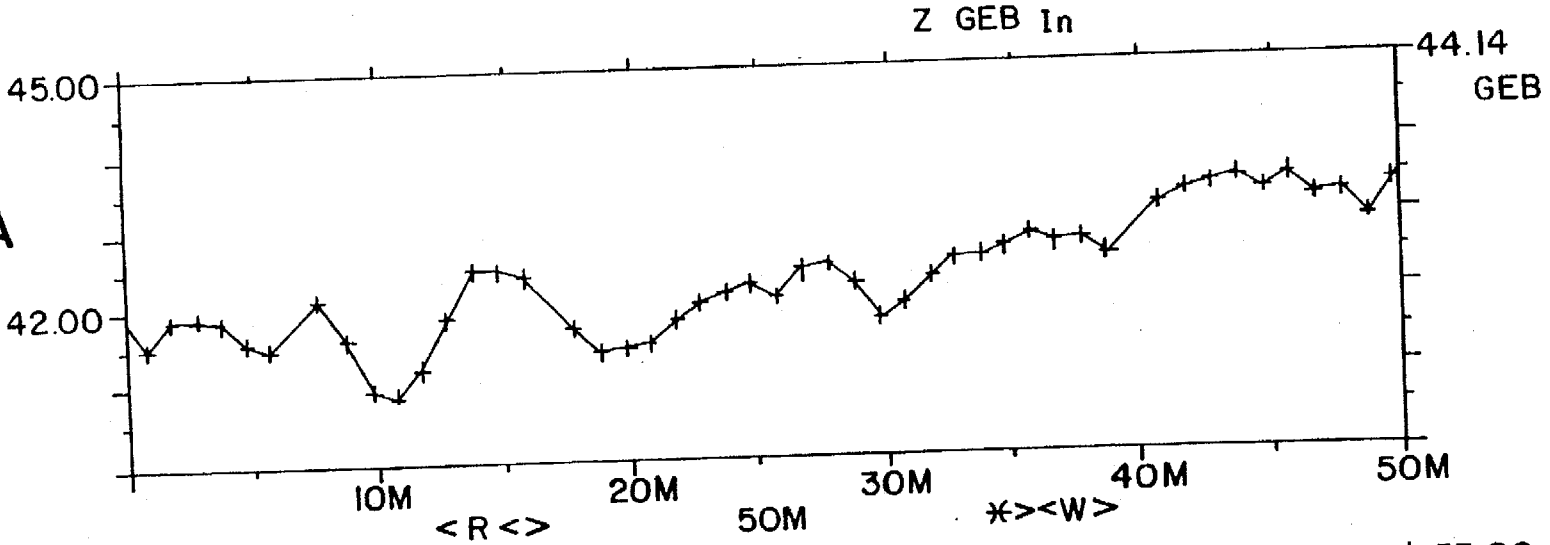
FIGS. 7*a* and *b* are brightness levels exiting a reactor.
Figure 7B:
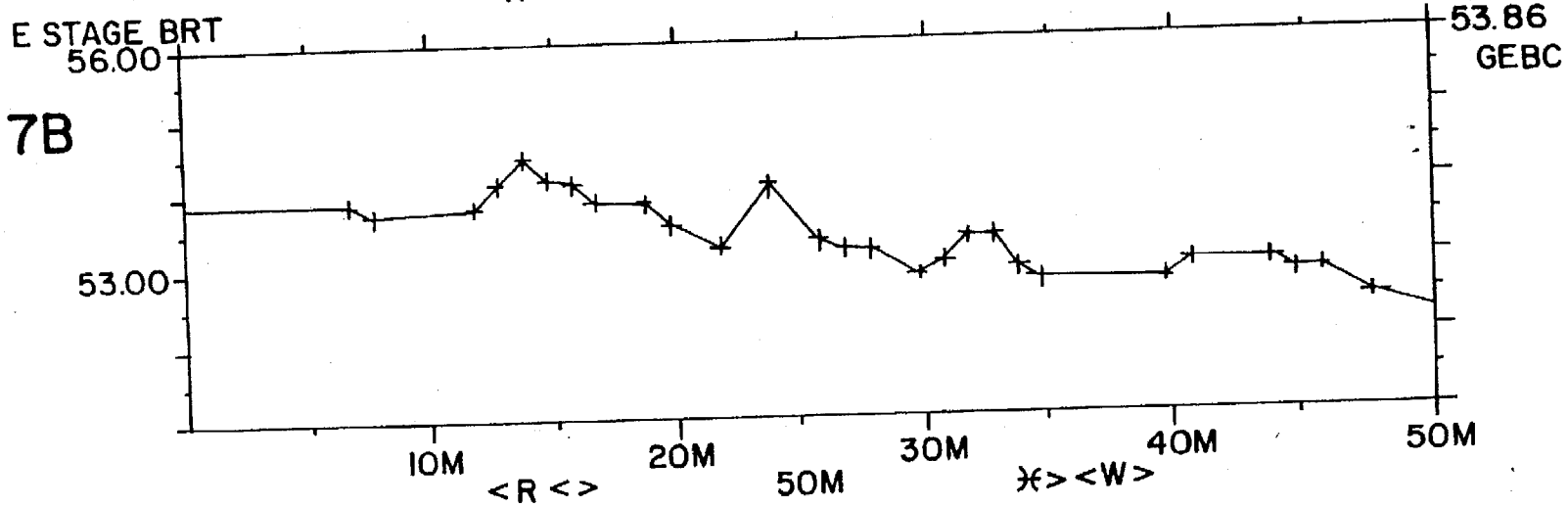

FIG. 7 is an attempt to depict the stabilizing effect of the control system on the exiting brightness. The on-line measurement shown in FIG. 7*a* is the brightness entering the Z stage of F-line's OZEoD sequence. The on-line measurement shown in FIG. 7*b* is the brightness exiting the Eo stage of F-line's OZEoD sequence. The Eo brightness was time-shifted 80 minutes, in accordance with estimates of the residence time in the Z and Eo stages. The variation in the brightness of the ozonation-stage pulp was decreased.

The invention being thus described, it will be obvious that the same may be varied in many ways. Such variations are not to be regarded as a departure from the spirit and scope of the invention and all such modifications are intended to be included within the scope of the following claims.

What is claimed is:

1. A coupled control method for controlling a continuous ozone bleaching process for paper pulp to a desired degree of bleaching, which comprises:

(a) adding feed ozone at a desired amount to the pulp;

(b) passing the pulp continuously into and out of a bleaching reactor;

(c) measuring ingoing pulp brightness between successive ingoing pulp K number measurements; and (d) adjusting the quantity of feed ozone required to reach a desired degree of bleaching in response to the measured brightness and K number values.

2. The method of claim 1, wherein the brightness values are measured periodically between successive K number measurements.

3. The method of claim 1, wherein the brightness values are measured continuously between successive K number measurements.

4. The method of claim 1, wherein the brightness values of multiple measurements are averaged together to derive a brightness value which is used to initiate an adjustment in the quantity of feed ozone.

5. The method of claim 1, wherein the quantity of feed ozone is also adjusted by a moving average of at least three K number measurements.

6. The method of claim 1, wherein the adjusting step comprises:

(a) periodically measuring the K number of the incoming pulp as it passes into the reactor and adjusting the amount of feed ozone to obtain the desired degree of bleaching;

(b) measuring the pulp brightness between periodic K number measurements, and making a moving average of several pulp brightness measurements;

(c) comparing the average brightness measurement with the brightness representing the K number for that period prior to the next K number measurement to initiate a change in feed ozone; and (d) adjusting the quantity of feed ozone in response to the comparison value.

7. The method of claim 6, wherein step (b) is repeated periodically.

8. The method of claim 6, wherein the step (b) is repeated continuously.

9. The method of claim 6, wherein the pulp brightness is measured about every second to about ten minutes between K number measurements.

10. The method of claim 6, wherein the ingoing measured pulp property is the pulp K number-In ($K_{In}$) and the outgoing measured pulp property is the pulp K number-Out ($K_{Out}$) and the desired degree of bleaching is the target K number-Out (target $K_{Out}$) and the expected K number entering the ozone stage is the target K number-In (target $K_{In}$).

11. The method of claim 6, wherein the ozone application required to bleach the pulp is calculated from the formula:

$$O_{3app}=C_1+C_2([K_{In}]-[\text{target } K_{In}])+C_3([\text{captured } GEB_{In}]-[GEB_{In}])+C_4([K_{Out}]-[\text{target } K_{Out}])+C_5([\text{captured } GEB_{Out}]-[GEB_{Out}])$$

wherein $O_{3app}$ is the calculated ozone application necessary to achieve the desired degree of bleaching, and $C_1$ through $C_5$ are constants.

12. The method of claim 6, wherein the amount of ozone is further adjusted by correcting for at least the pH of the ingoing pulp, the temperature of the ingoing pulp, or the residence time of the pulp in the reactor.

13. A coupled control method for controlling a continuous ozone bleaching process for paper pulp to a desired degree of bleaching, which comprises:

(a) adding feed ozone at a desired amount to the pulp;

(b) passing the pulp continuously into and out of a bleaching reactor;

(c) measuring the brightness value of the pulp between successive K number measurements; and (d) adjusting the quantity of feed ozone required to reach a desired degree of bleaching in response to the measured brightness and K number values;

wherein the measured pulp property is an ingoing pulp property; and the adjusting step comprises:

(e) periodically measuring the K number of the incoming pulp as it passes into the reactor and adjusting the amount of feed ozone to obtain the desired degree of bleaching;

(f) measuring the pulp brightness between periodic K number measurements, and making a moving average of several pulp brightness measurements;

(g) comparing the moving average brightness measurement with the brightness representing the K number for that period prior to the next K number measurement to initiate a change in feed ozone; and (h) adjusting the quantity of feed ozone in response to the comparison value.

14. The method of claim 13, wherein the ingoing measured pulp property is the pulp K number-In ($K_{In}$) and the outgoing measured pulp property is the pulp K number-Out ($K_{Out}$) and the desired degree of bleaching is the target K number-Out (target $K_{Out}$) and the expected K number entering the ozone stage is the target K number-In (target $K_{In}$) and the "$GEB_{In}$" and "$GEB_{Out}$" are the pulp brightness values measured between consecutive K number measurements at the entrance and exit of the ozone reactor respectively and with each K number measurement, a new brightness of the ingoing pulp and/or outgoing pulp is captured and these captured brightnesses are referred to as "captured $GEB_{In}$" and "captured $GEB_{Out}$".

15. The method of claim 13, wherein the ozone application required to bleach the pulp comprises the formula:

$$O_{3app}=C_1+C_2([K_{In}]-[\text{target } K_{In}])+C_3([\text{captured } GEB_{In}]-[GEB_{In}])+C_4([K_{Out}]-[\text{target } K_{Out}])+C_5([\text{captured } GEB_{Out}]-[GEB_{Out}])$$

wherein $O_{3app}$ is the calculated ozone application necessary to achieve the desired degree of bleaching, and $C_1$ through $C_5$ are constants.

16. The method of claim 13, wherein the amount of ozone is further adjusted by correcting for at least the pH of the ingoing pulp, the temperature of the ingoing pulp, or the residence time of the pulp in the reactor.

* * * * *